United States Patent [19]

Mendenhall

[11] Patent Number: 4,911,045

[45] Date of Patent: Mar. 27, 1990

[54] DECORATIVE FORM HYDRAULIC FOOD PRODUCT CUTTING BLADE ASSEMBLY

[76] Inventor: George A. Mendenhall, 4252 S. Eagleson Rd., Boise, Id. 83705

[21] Appl. No.: 268,676

[22] Filed: Nov. 7, 1988

Related U.S. Application Data

[63] Continuation of Ser. No. 59,614, Jun. 8, 1987, abandoned.

[51] Int. Cl.[4] ..... B26D 7/06; B26D 1/03

[52] U.S. Cl. ..... 83/98; 83/24; 83/402

[58] Field of Search ..... 83/24, 27, 98, 402; 30/305, 315; 426/518

[56] References Cited

U.S. PATENT DOCUMENTS

| | | | |
|---|---|---|---|
| 1,741,682 | 12/1929 | Desmond . | |
| 2,119,260 | 5/1938 | Valle | 30/316 |
| 2,483,173 | 9/1949 | Behnke . | |
| 3,109,468 | 11/1963 | Lamb et al. | 99/589 |
| 4,082,024 | 4/1978 | Hodges et al. | 83/402 |
| 4,300,429 | 11/1981 | Brown et al. | 83/857 |
| 4,372,184 | 2/1983 | Fisher et al. | 83/98 |
| 4,423,652 | 1/1984 | Winslow | 83/98 |
| 4,538,491 | 9/1985 | Henneuse | 83/402 |
| 4,614,141 | 9/1986 | Mendenhall et al. | 83/98 |

FOREIGN PATENT DOCUMENTS

| | | |
|---|---|---|
| 0059075 | 2/1982 | European Pat. Off. . |
| 2054004 | 4/1971 | France . |

*Primary Examiner*—Donald R. Schran
*Assistant Examiner*—Scott A. Smith
*Attorney, Agent, or Firm*—Frank J. Dykas

[57] ABSTRACT

A cutter blade assembly 10 for the production of a decorative food core 18 for use with hydraulic food cutting apparatus has a frame constructed from a series of sequential rings 11, 12 and 13 which together define a longitudinal passageway. A plurality of strip knives 15 are arranged therein to define various segments of the longitudinal passageway and are connected to rings 11, 12 and 13 by inserting the end tabs of strip knives 15 into notches 14. Rings 11, 12 and 13 are then bolted together by the use of bolts passing through holes 16.

14 Claims, 5 Drawing Sheets

DECORATIVE FORM HYDRAULIC FOOD PRODUCT CUTTING BLADE ASSEMBLY

This is a continuation application of Ser. No. 07/059,614, filed on 06/08/87, now abandoned.

BACKGROUND OF THE INVENTION

1. Field of Invention

This invention relates to cutting blade assemblies for hydraulic food cutting apparatus. More particularly it relates to a cutter blade assembly which defines a core area and a peripheral scrap area wherein the core area of the food product is cut into a recognizable decorative form.

2. Description of the Prior Art

Many food products, and particularly vegetables and fruits are processed prior to sale either by canning or freezing. Unless the product involved is of a naturally occurring edible size, for example peas, the product is usually trimmed and sliced, or diced, to edible size prior to preservation processing such as canning or freezing.

These slicing, dicing and other cutting operations have traditionally been accomplished with mechanical cutters. However, relatively recent advances in food product cutting technologies has resulted in the common use of hydraulic cutting apparatus which can be used to cut relatively huge quantities of food product at very high speeds. Cutting capacities of 30,000 pounds to 50,000 pounds per hour are not unusual.

F.G. LAMB, ET AL., U.S. Pat. No. 3,109,468 discloses a typical hydraulic cutting apparatus wherein the food product to be cut, namely potatoes, are dropped into a tank filled with water and the pumped through conduit into an alignment chute wherein the potatoes are aligned and accelerated to high speed before impinging upon a cutter blade assembly where the potato core is cut into a plurality of french files and the peripheral area of the potato is sliced off and diverted from the main flow of core product for later retrieval for other uses.

Hydraulic cutting apparatus, or as they are known in the trade, hydroknives, can be utilized to cut extremely high volumes of product if the food product can be properly aligned and accelerated to high speed immediately prior to impact with the cutter blade assembly. Initial development areas in the art were focused upon various apparatus and methods for properly aligning the food product. HODGES, ET AL., U.S. Pat. No. 4,082,024, discloses a typical hydroknife cutting apparatus. WINSLOW, U.S. Pat. No. 4,423,652, HENNEUSE, U.S. Pat. No. 4,538,491 and my patent MENDENHALL, U.S. Pat. No. 4,614,141, all disclose various apparatus for improving the alignment and acceleration of the food product prior to impact with the cutter blade assembly.

Other areas wherein improvements have been made specifically relate to particular food products. More specifically, BROWN, ET AL., U.S. Pat. No. 4,300,429, discloses a cutter blade assembly which cuts french fry strips of varying cross sectional area so as to compensate for the nonuniform solids content between the center of the potato and the peripheral areas so that the end product french fries will cook at a uniform rate. FISHER, ET AL., U.S. Pat. No. 4,372,184, discloses a cutter blade assembly for use in coring a potato.

Quite obviously there are a variety of applications for hydraulic cutter knives other than just for potatoes.

Some of these would include beets, pickles, carrots, apples, pineapples and literally a host of other edible food products.

However none of the prior art discloses or teaches a method of utilizing a hydroknife apparatus for cutting the core of the product into a decorative form so as to enhance the marketing value of the processed food product, such as fish-shaped french fries for fast food seafood restaurants. Or, to enhance the edible appeal of the product in relationship to a particular market group such as alphabet french fries for small children.

Decorative cut food products have been developed and successfully marketed for many years. However, as a universal rule, they are formed products as opposed to directly cut from food product in original cellular form. Examples include cookie and pasta dough which is then either extruded and then cross sliced or sheet cut by cookie cutter type apparatus. The direct cutting of a decorative shape of a product core, which can then be cross sliced has not been attempted before.

Accordingly, it is an object of this invention to produce a cutter blade assembly which can be utilized in a hydraulic cutting apparatus to cut the core of food product passing through the cutter blade assembly into a decorative, recognizable shape.

SUMMARY OF INVENTION

This object is achieved by use of a cutter blade assembly wherein a plurality of strip knives are utilized to define peripheral segments of the longitudinal passageway which result in a residual cross sectional core area having a particular decorative shape.

Because of the dynamic forces associated with the impact of the product against the strip knives, and the need to frequently sharpen the strip knives, it is not practical to fabricate the complete form from a single strip knife in cookie cutter fashion. Instead, the perimeter frame is subdivided into a number of parallel sequential planes, each containing strip knives which define particular segments of the peripheral area.

End tabs on the strip knives are inserted into notches in the perimeter frame and are held firmly in position to minimize wobble by compression of said tabs inserted into the perimeter frame from the strip knives when the various sections of the perimeter frame are bolted together.

DETAILED DESCRIPTION OF THE PREFERRED EMBODIMENT

Figure 1:
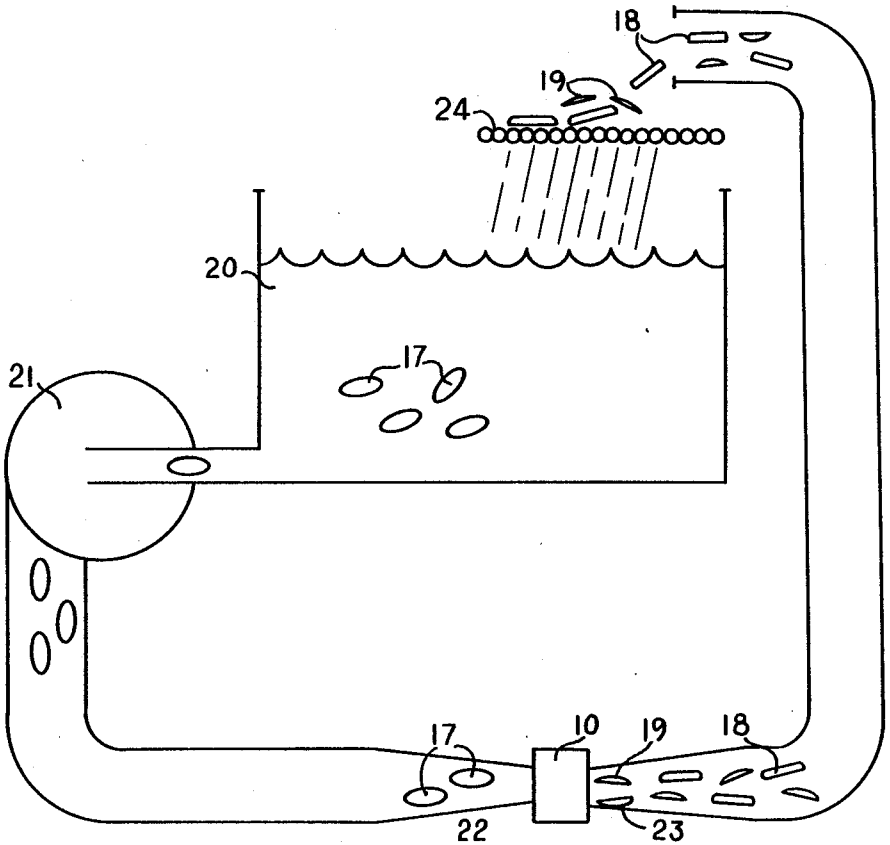
FIG. 1 is a schematic representation of a hydraulic cutting apparatus.

FIG. 1 shows, in schematical format, the main components of a hydraulic cutting apparatus for use in cutting potatoes. Potatoes 17 are dumped into the water filled receiving tank 20. Food pump 21, usually a single impeller centrifugal pump, draws its suction from receiving tank 20, and pumps water and the suspended potatoes 17 from the tank into nozzle gun 22.

Nozzle gun 22 functions as a venturi which is used to accelerate and align potatoes 17 immediately prior to impinging upon the knife blades of cutter blade assembly 10. Depending upon the product being cut, its size, core density and physical characteristics, normal speeds at the point of impingment upon the knife blades of cutter blade assembly 10 range from forty feet per second to sixty feet per second.

The cut product, which in this case is a decoratively shaped potato core 18, and the peripheral scrap 19 exit cutter blade assembly 10 into deceleration loop 23 which in effect is the second half of the venturi. The deceleration loop returns to a point above receiving tank 20 where the water, cut cores 18 and scrap 19 are deposited onto chain separator 24. The water passes through chain separator 24 and returns to receiving tank 20. Chain separator 24 is typically an endless loop chain or dewatering shaker which is used to mechanically remove the potatoes from the hydraulic cutting apparatus assembly. The decorative cores 18 and scrap 19 are then usually mechanically separated by means of a sizer conveyor, not shown. The cores 18 are then sliced, again usually mechanically, into appropriate thicknesses for further processing by blanching, freezing and packaging for sale.

The cutter blade assemblies in use today normally run at capacities of 30,000 pounds per hour to 50,000 pounds per hour, and can be operated at capacities of up to 100,000 pounds of product per hour. During the course of an eight hour work shift, that represents a relatively huge amount of food product passing through the cutter blade assembly, and as a result, strip knives are removed for resharpening about once per eight hour work shift.

Figure 2:
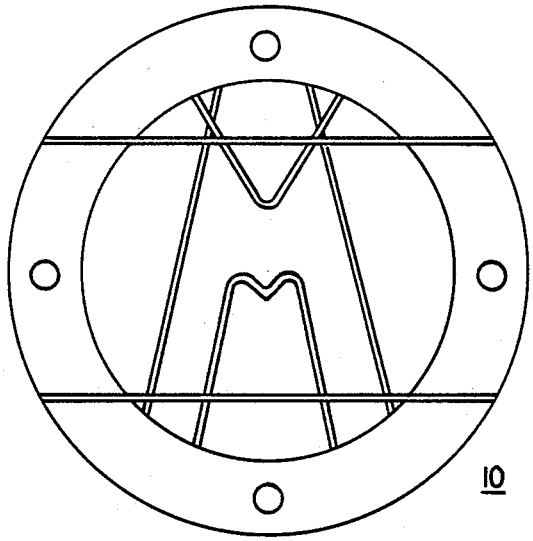
FIG. 2 is the top plan view of a cutter blade assembly for cutting a decorative M.
Figure 3:
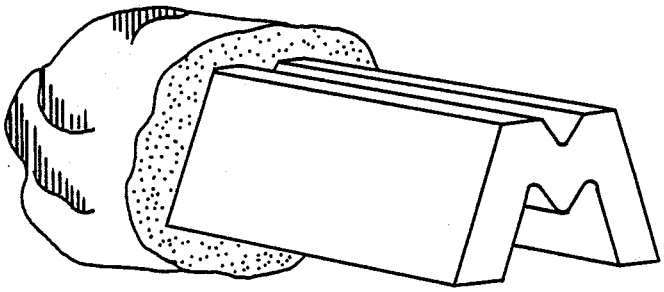
FIG. 3 is a representational perspective view of a partially cut potato core in the shape of an M.
Figure 4:
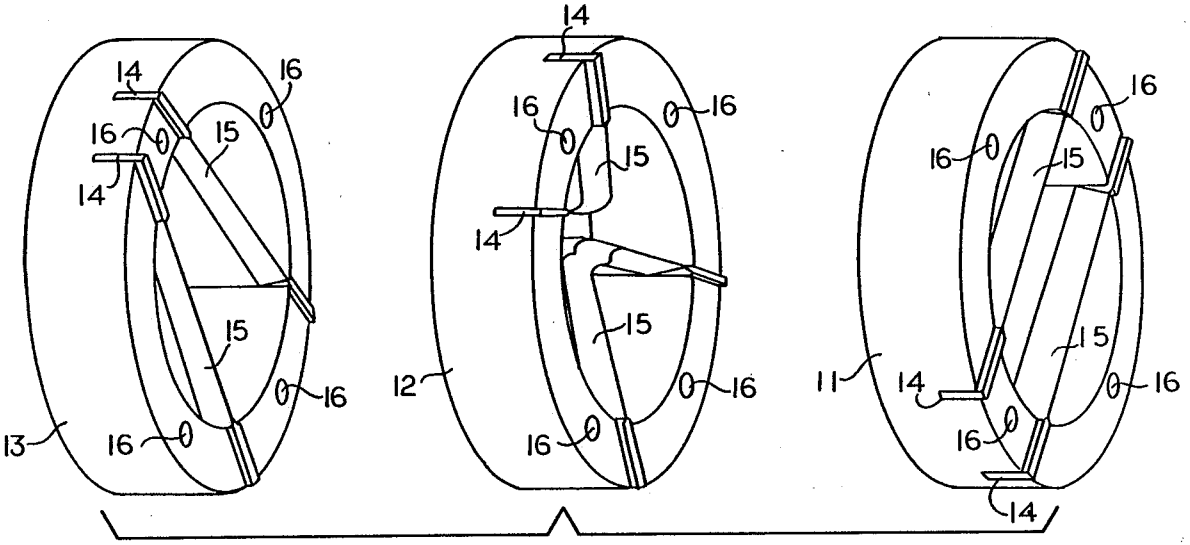
FIG. 4 is a representational perspective view of the cutter blade assembly for cutting a decorative core M.
Figure 5:
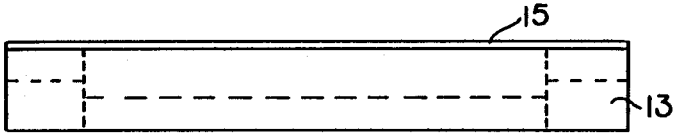
FIG. 5 is a representational side view of a cutter blade ring and blade.

Referring to FIGS. 2, 4 and 5, my cutter blade assembly, in an embodiment designed to produce a potato core in the shape of an M, as shown in FIG. 3, is disclosed. In order to produce the decorative M, as is shown in FIGS. 2 and 3, a plurality of strip knives must be utilized to cut away peripheral segments of the potato in order to define an M in the core area of the potato. The end tabs of strip knives 15 as is shown in FIGS. 4 and 5 are inserted into notches 14 of rings 11, 12 and 13, each ring and its connecting strip knives 15 defining a separate array, and all rings together defining a multisegmented peripheral volume of the longitudinal passageway. By arranging a plurality of strip knives 15 to define various segments of the longitudinal passageway, the residual cross sectional core area can be shaped into a variety of recognizable decorative forms. In the case of a decorative M as shown in FIGS. 2, 3, and 4, six strip knives are required, and resultin a core in the form of a decorative M and up to twelve separate peripheral areas. Referring to FIG. 2, whole potato 17 is schematically represented at the point where it is just about to impinge upon the cutter blade assembly 10. It can be seen that potato 17 will be cut into a potato core having a cross sectional shape of an M and twelve separate peripheral scraps.

FIG. 5 is a representational side view which shows a feature of my invention which results in a minimization of wobble of the strip knives in the cutter blade assembly. The end tab sections of strip knife 15 are slightly elevated above the plane surface of ring 13 so that when all of the rings containing the strip knives are bolted together by use of bolts passing through holes 16, strip knives 15 will be tightly clamped into place.

This design, as is shown in FIGS. 4 and 5 results in a cutter blade assembly which can be quickly disassembled for purposes of removing and sharpening strip knives 15.

Figure 6:
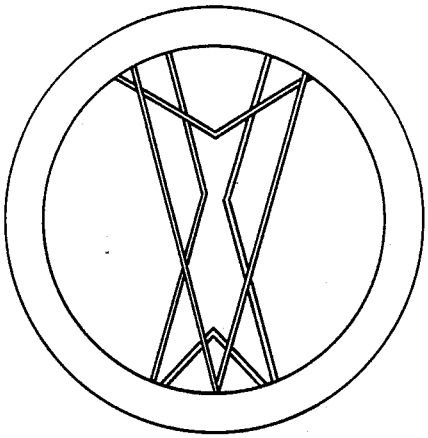
FIG. 6 is ia representational view of the cutter blade assembly for cutting a single decorative fish shaped core.
Figure 8:
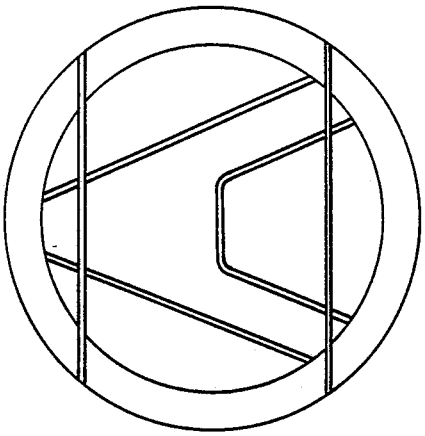
FIG. 8 is a representational view of the cutter blade assembly for cutting a decorative A shaped core.
Figure 7:
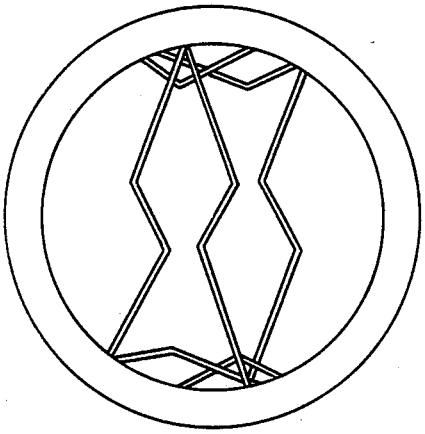
FIG. 7 is a representational view of the cutter blade assembly for cutting two decorative fish shaped cores.
Figure 10:
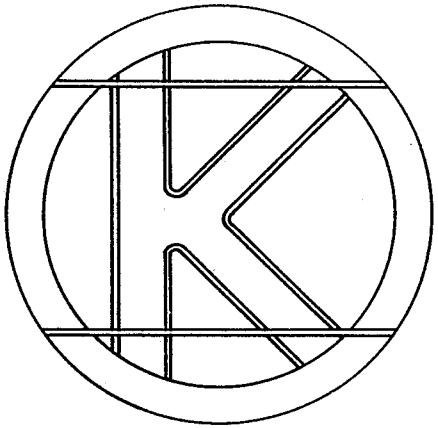
FIG. 10 is a representational view of the cutter blade assembly for cutting a decorative K shaped core.
Figure 9:
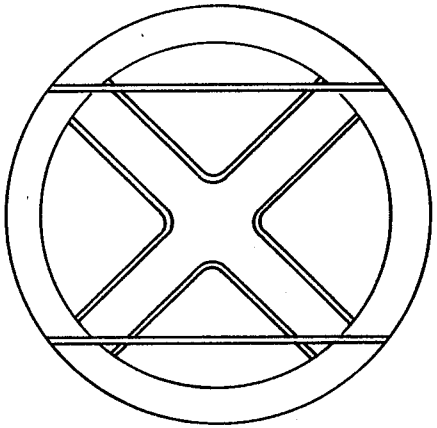
FIG. 9 is a representational view of the cutter blade assembly for cutting an decorative X shaped core.

FIGS. 6 through 10 show other configurations of the strip knives which are designed to produce decorative shape cores in a variety of different configurations. FIGS. 6 and 7 disclose strip knife configurations which result in a decorative core in the shape of fish. FIG. 6 uses six strip knives to configure the core in the shape of a single fish. It requires the use of three sectional rings to hold six strip knives. FIG. 7 discloses a strip knife configuration which results in the product core being cut into two decorative fish sections, and requires the use of eight strip knives and four ring sections. FIGS. 8, 9 and 10 disclose other configurations of strip knives which result in core shapes in the form of an A, X and K. In practice it has been found that virtually all of the letters of the alphabet as well as decorative geometric shapes such as stars and triangles can be easily produced by varying the configurations of the strip knives.

While there is shown and described the present preferred embodiment of the invention, it is to be distinctly understood that this invention is not limited thereto but may be variously embodied to practice within the scope of the following claims. Accordingly,

What I claim is:

1. In a system for the cutting of food products into decorative forms, having a product receiving tank adapted to be filled with a fluid medium, means to discharge said products into said tank, a food pump for withdrawing said medium and said products from said tank, a product feed line, said pump discharging said products into said product feed line, a tapered section in said feed line to separate, align, accelerate and feed said products into a cutter blade assembly, and means posterior to said cutter blade assembly, to discharge cut product, wherein the improvement comprises a cutter blade assembly having:

a perimeter frame having an inner longitudinal passage of size and shape for the longitudinal passage of product and fluid medium there through at a speed of greater than 40 feet per second and less than 60 feet per second;

a plurality of sequentially arranged strip knives disposed one after another within the longitudinal passageway of said perimeter frame for forming a single non-triangular, non-rectilinear, non-circular decoratively shaped food product core by segmenting said longitudinal passageway into a plurality of peripheral segments for the cutting of a food product passed therethrough said plurality of strip knives being of size and shape so as to define said peripheral segments of the longitudinal passageway which results in the cross sectional shape of the core having a single non-triangular, non-rectilinear, non-circular decorative shape.

2. The apparatus of claim No. 1 wherein said plurality of strip knives define segments of the longitudinal passageway resulting in the core cut area defining the shape of a fish.

3. The apparatus of claim no. 1 wherein said plurality of strip knives define segments of the longitudinal passageway resulting in the core cut area defining the shape of an alphanumeric character.

4. The apparatus of claim no. 1 wherein said plurality of strip knives define segments of the longitudinal passageway resulting in the core cut area defining the shape of a person.

5. The apparatus of claim no. 1 wherein said plurality of strip knives define segments of the longitudinal passageway resulting in the core cut area defining the shape of an animal.

6. The apparatus of claim no. 1 wherein said plurality of strip knives define segments of the longitudinal passageway resulting in the core cut area defining the shape of a recognizable geometric form.

7. The cutter blade assembly of claim no. 1 wherein said plurality of strip knives are further arranged and shaped to limit the length and number of blades contacting any one segment of the food product at any given time during the passage of the food product through the longitudinal passageway whereby the frictional and shear force imparted to the food product being cut and the resulting deceleration of food product are minimized.

8. The apparatus of claim no. 7 wherein said plurality of strip knives define segments of the longitudinal passageway resulting in the core cut area defining the shape of a fish.

9. The apparatus of claim no. 7 wherein said plurality of strip knives define segments of the longitudinal passageway resulting in the core cut area defining the shape of an alphanumeric character.

10. The apparatus of claim no. 7 wherein said plurality of strip knives define segments of the longitudinal passageway resulting in the core cut area defining the shape of a person.

11. The apparatus of claim no. 7 wherein said plurality of strip knives define segments of the longitudinal passageway resulting in the core cut area defining the shape of an animal.

12. The apparatus of claim no. 7 wherein said plurality of strip knives define segments of the longitudinal passageway resulting in the core cut area defining the shape of a recognizable geometric form.

13. In a system for the cutting of food products into decorative forms, having a product receiving tank adapted to be filled with a fluid medium, means to discharge said products into said tank, a food pump for withdrawing said medium and said products from said tank, a product feed line, said pump discharging said products into said product feed line, a tapered section in said feed line to separate, align, accelerate and feed said products into a cutter blade assembly, and means posterior to said cutter blade assembly, to discharge cut product, wherein the improvement comprises a cutter blade assembly having:

a perimeter frame having an inner longitudinal passage of size and shape for the longitudinal passage of product and fluid medium there through at a speed of greater than 40 feet per second and less than 60 feet per second;

a plurality of sequentially arranged arrays of strip knives disposed one after another within the longitudinal passageway of said perimeter frame wherein each of said arrays of strip knives is shaped to cut away different portions of the periphery of a single non-triangular, non-rectilinear, non-circular decorative food core as the food product sequentially impacts each array of strip knives thereby minimizing deceleration of the food core within said passageway.

14. In a system for the cutting of food products into decorative forms, having a product receiving tank adapted to be filled with a fluid medium, means to discharge said products into said tank, a food pump for withdrawing said medium and said products from said tank, a product feed line, said pump discharging said products into said product feed line, a tapered section in said feed line to separate, align, accelerate and feed said products into a cutter blade assembly, and means posterior to said cutter blade assembly, to discharge cut product, wherein the improvement comprises a cutter blade assembly having:

a perimeter frame having an inner longitudinal passage of size and shape for the longitudinal passage of product and fluid medium there through at a speed of greater than 40 feet per second and less than 60 feet per second;

a plurality of strip knives, each being shaped to cut a different portion of the total perimeter of a single non-triangular, non-rectilinear, non-circular decorative food core, said strip knives being disposed within said perimeter frame in sequential fashion, one after another along the longitudinal food path, whereby deceleration of the food product is minimized within said cutter blade assembly.

* * * * *